United States Patent [19]

Masui

[11] Patent Number: 4,817,383

[45] Date of Patent: Apr. 4, 1989

[54] DOUBLE AIR-FUEL RATIO SENSOR SYSTEM HAVING IMPROVED EXHAUST EMISSION CHARACTERISTICS

[75] Inventor: Takatoshi Masui, Mishima, Japan

[73] Assignee: Toyota Jidosha Kabushiki Kaisha, Aichi, Japan

[21] Appl. No.: 112,956

[22] Filed: Oct. 27, 1987

[30] Foreign Application Priority Data

Nov. 8, 1986 [JP] Japan ..... 61-264886

[51] Int. Cl.[4] ..... F02D 41/14; F01N 3/20

[52] U.S. Cl. ..... 60/274; 60/276; 60/285; 123/489

[58] Field of Search ..... 123/440, 489, 589, 479; 60/274, 276, 285; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler et al. | 123/440 |
| 4,235,204 | 11/1980 | Rice | 123/440 |
| 4,244,340 | 1/1981 | Herth et al. | 123/489 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |
| 4,707,984 | 11/1987 | Katsuno et al. | 123/489 |

FOREIGN PATENT DOCUMENTS

| | | |
|---|---|---|
| 52-102934 | 8/1977 | Japan . |
| 53-103796 | 9/1978 | Japan . |
| 55-37562 | 3/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-48755 | 3/1983 | Japan . |
| 58-48756 | 3/1983 | Japan . |
| 58-53661 | 3/1983 | Japan . |
| 58-72647 | 4/1983 | Japan . |
| 58-72646 | 4/1983 | Japan . |
| 58-135343 | 8/1983 | Japan . |
| 58-152147 | 9/1983 | Japan . |
| 58-150039 | 9/1983 | Japan . |
| 58-150038 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar

*Attorney, Agent, or Firm*—Parkhurst, Oliff & Berridge

[57] ABSTRACT

In a double air-fuel sensor system including two air-fuel ratio sensors upstream and downstream of a catalyst converter provided in an exhaust gas passage, an air-fuel ratio correction amount is calculated in accordance with the outputs of the upstream-side and downstream-side air-fuel ratio sensors, thereby obtaining an actual air-fuel ratio. When a time period of reversions of the output of the downstream-side air-fuel ratio sensor is larger than a predetermined value, the calculation of the air-fuel ratio correction amount by the output of the downstream-side air-fuel ratio sensor is prohibited.

14 Claims, 18 Drawing Sheets

| Fig. 5A | Fig. 5 B | Fig. 5C |
|---|---|---|

LEAN
RICH
A/F
TDR
CDLY 0
t1
t2
t3
t4
t5
t6
t7
t8
TDL
A/F'
(F1)

TDR
LEAN
RICH
(-TDL)
TDR

RSL
KIR
FAF1
RSR
KIL

| Fig. 7 A | Fig. 7 B | Fig. 7 C |
|---|---|---|

V
1
0
RICH
LEAN
TDR
TDL
KIR
RSL
FAF1
RSR
KIL
V
t1
t2
V2
t3
VR2
F2
LEAN
RICH
14
0
C
KI2
RS2
RS2
KI2
FAF2

| Fig. 10 A | Fig. 10 B | Fig. 10 C |
|---|---|---|

V
1
0
RICH
LEAN
TDR
TDL
KIR
RSL
FAF1
RSR
KIL
t1
t2
V2
t3
VR2
F2
14
C
MAX
MIN

DOUBLE AIR-FUEL RATIO SENSOR SYSTEM HAVING IMPROVED EXHAUST EMISSION CHARACTERISTICS

BACKGROUND OF THE INVENTION (1) Field of the Invention

The present invention relates to a method and apparatus for feedback control of an air-fuel ratio in an internal combustion engine having two air-fuel ratio sensors upstream and downstream of a catalyst converter disposed within an exhaust gas passage.

(2) Description of the Related Art

Generally, in a feedback control of the air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio.

According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_X$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. Nos. 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor is addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream-side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstream-side $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ sensor are stable, good emission characteristics are still obtained.

In the above-mentioned double $O_2$ sensor system, for example, an air-fuel ratio feedback control parameter such as a rich skip amount RSR and/or a lean skip amount RSL is calculated in accordance with the output of the downstream-side $O_2$ sensor, and an air-fuel ratio correction amount FAF is calculated in accordance with the output of the upstream-side $O_2$ sensor and the air-fuel ratio feedback control parameter. Usually, in view of the transient characteristics and the deterioration of the drivability due to the fluctuation of the air-fuel ratio, the air-fuel ratio feedback control parameter is guarded within a predetermined range defined by a maximum value MAX and a minimum value MIN (see: Japanese Unexamined Japanese Patent Publication Nos. 61-232350 and 61-234241, and the corresponding U.S. patent application No. 848,580, now U.S. Pat. No. 4,693,076). In this case, when the three-way catalysts are new and properly activated, or when the engine is in a low intake air amount region, the time period of reversions of the downstream-side $O_2$ sensor is extended, as illustrated in FIG. 2A. On the other hand, when the three-way catalysts are old and not properly activated, or when the engine is in a high intake air amount region, the time period of reversions of the output of the downstream-side $O_2$ sensor is shortened, as illustrated in FIG. 2B. Therefore, if a speed of renewal of the air-fuel ratio feedback conforms to the case where the time period of reversions of the output of the downstream-side $O_2$ sensor is extended, when the engine is in a state where the time period of reversions of the output of the downstream-side $O_2$ sensor is shortened, the correction of the air-fuel ratio feedback control parameter is not sufficient, and accordingly, the correction of the air-fuel ratio is not sufficient, thus increasing the emissions. On the other hand, if a speed of renewal of the air-fuel ratio feedback conforms to the case where the time period of reversions of the output of the downstream-side $O_2$ sensor is shortened, when the engine is in a state here the time period of reversions of the output of the downstream-side $O_2$ sensor is extended, the correction of the air-fuel ratio feedback control parameter is so excessive that the air-fuel ratio feedback control parameter promptly reaches the maximum value MAX or the minimum value MIN of the predetermined range. As a result, the transient characteristics of a rapid change of the air-fuel ratio deteriorate and the emissions are increased.

It may be suggested to reduce the speed of renewal speed of the air-fuel ratio feedback control parameter when the engine is in a low intake air amount region, however, in this case, when the three-way catalysts are deteriorated and have lost the $O_2$ storage effect, the correction of the air-fuel ratio feedback control parameter is too slow, thus also increasing the emissions.

SUMMARY OF THE INVENTION

It is an object of the present invention to provide a double air-fuel ratio sensor system having an improved exhaust emission, drivability, and transient characteristics when a time period of revisions of a downstream-side air-fuel ratio sensor is extended.

According to the present invention, in a double air-fuel sensor system including two air-fuel ratio sensors upstream and downstream of a catalyst converter provided in an exhaust gas passage, an air-fuel ratio correction amount is calculated in accordance with the outputs of the upstream-side and downstream-side air-fuel ratio sensors, thereby obtaining an actual air-fuel ratio. When a time period of reversions of the output of the downstream-side air-fuel ratio sensor is longer than a predetermined value, the calculation of the air-fuel ratio correction amount by the output of the downstream-side air-fuel ratio sensor is prohibited, i.e., the air-fuel ratio feedback control by the downstream-side air-fuel ratio sensor is stopped.

Note that, when the air-fuel ratio feedback control by the downstream-side air-fuel ratio sensor is stopped, effective use is not made of a double air-fuel ratio sensor system which has a function of correcting a deviation of the mean air-fuel ratio by the upstream-side air-fuel ratio sensor from the stoichiometric air-fuel ratio. However, when the three-way catalysts exhibit an excellent $O_2$ storage effect, the deterioration of the emissions due to the above-mentioned deviation are small and negligible.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
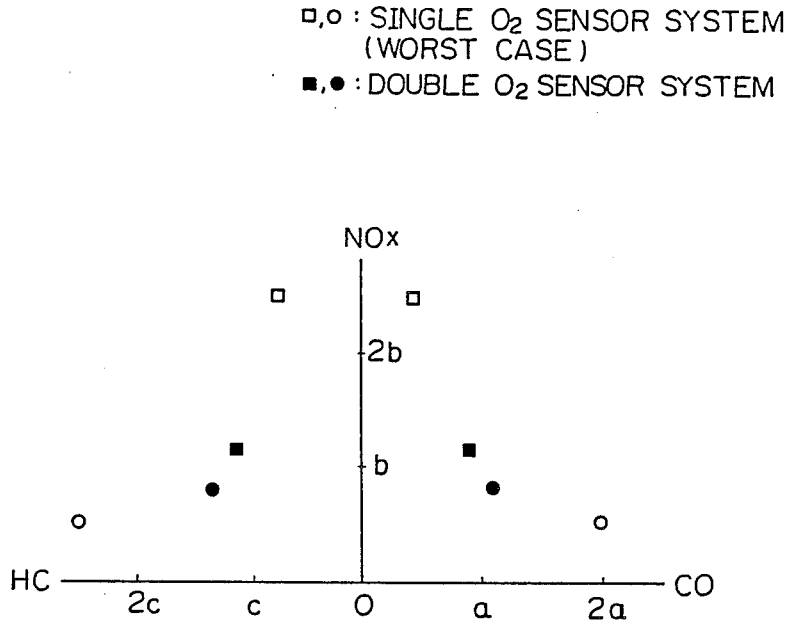
FIG. 1 is a graph showing the emission characteristics of a single $O_2$ sensor system and a double $O_2$ sensor system.
Figure 2A:
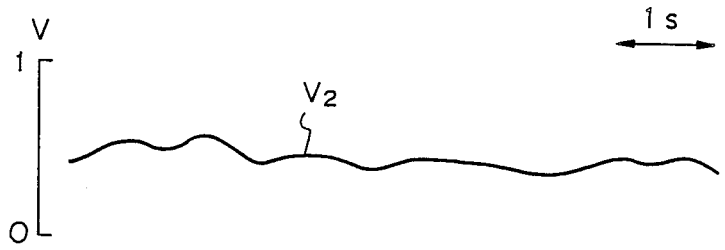
FIGS. 2A and 2B are timing diagrams showing examples of the output of a downstream-side air-fuel ratio sensor.
Figure 2B:
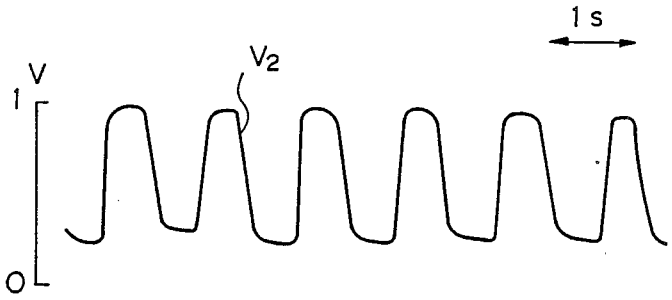
Figure 3:
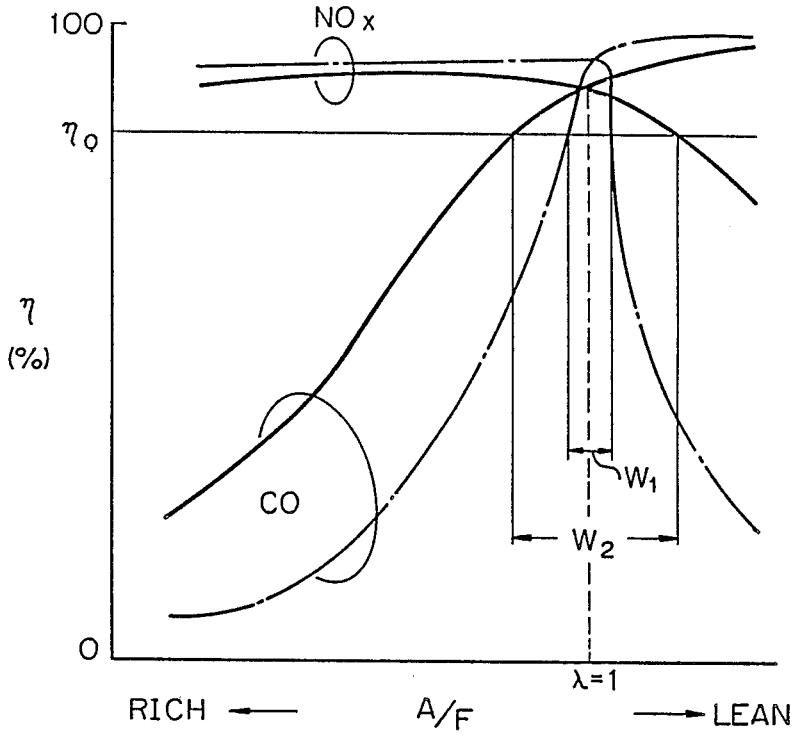
FIG. 3 is a graph showing the $O_2$ storage effect of three-way catalysts.

First, the cleaning rate characteristics of three-way catalysts will be explained with reference to FIG. 3. In FIG. 3, the ordinate $\eta$ represents the catalytic cleaning rate, and the abscissa A/F represents the air-fuel ratio of the exhaust gas. That is, as illustrated by dotted lines, when the air-fuel ratio is on the rich side with respect to the stoichiometric air-fuel ratio ($\lambda=1$), the cleaning rate $\eta$ of the $NO_X$ emission is increased, but when the air-fuel ratio is on the lean side with respect to the stoichiometric air-fuel ratio, the cleaning rate of the HC and CO emissions is increased (although HC is not shown, it has the same tendency as CO). As a result, if $\eta_0$ is an optimum cleaning rate, the controlled air-fuel ratio window is within a very narrow width $W_1$. However, the three-way catalysts have an $O_2$ storage effect whereby, when the air-fuel ratio is lean these catalysts absorb oxygen, and when the air-fuel ratio is rich they absorb and react HC and CO with the already absorbed oxygen. Therefore, since an air-fuel ratio feedback control makes positive use of this $O_2$ storage effect to obtain an optimum frequency and amplitude of the controlled air-fuel ratio, the cleaning rate $\eta$ is improved and thus the controlled air-fuel ratio window ($W=W_2$) is substantially increased.

Figure 4:
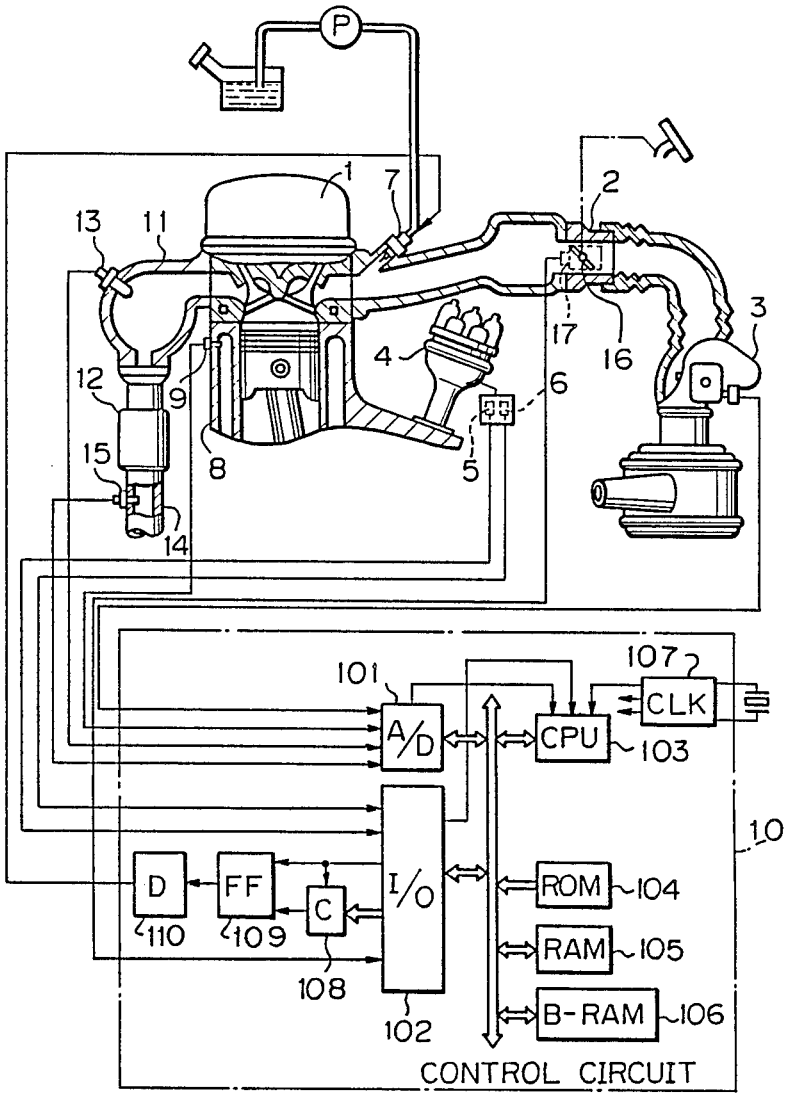
FIG. 4 is a schematic view of an internal combustion engine according to the present invention.

In FIG. 4, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air drawn into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1.

In this case, the crank-angle sensor 5 generates a pulse signal at every 720° crank angle (CA) while the crank-angle sensor 6 generates a pulse signal at every 30° CA. The pulse signals of the crank angle sensors 5 and 6 are supplied to an input/output (I/0) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, but are not shown in FIG. 4.

Disposed in a cylinder block 8 of the engine 1 is a coolant temperature sensor 9 for detecting the temperature of the coolant. The coolant temperature sensor 9 generates an analog voltage signal in response to the temperature THW of the coolant and transmits that signal to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_X$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $_2$ sensors 13 and 15 generate output voltage signals and transmit those signals to the A/D converter 101 of the control circuit 10.

Reference 16 designates a throttle valve, and 17 an idle switch for detecting whether or not the throttle valve 16 is completely closed.

The control circuit 10, which may be constructed by a microcomputer, further comprises a central processing unit (CPU) 103, a read-only memory (ROM) 104 for storing a main routine, interrupt routines such as a fuel injection routine, an ignition timing routine, tables (maps), constants, etc., a random access memory 105 (RAM) for storing temporary data, a backup RAM 106, an interface 102 of the control circuit 10.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is not erased even when the ignition switch (not shown) is turned off.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature data THW of the coolant sensor 9 are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA, i.e., at every pulse signal of the crank angle sensor 6, and is then stored in the RAM 105.

The operation of the control circuit 10 of FIG. 4 will be now explained.

Figures 5, 5A:
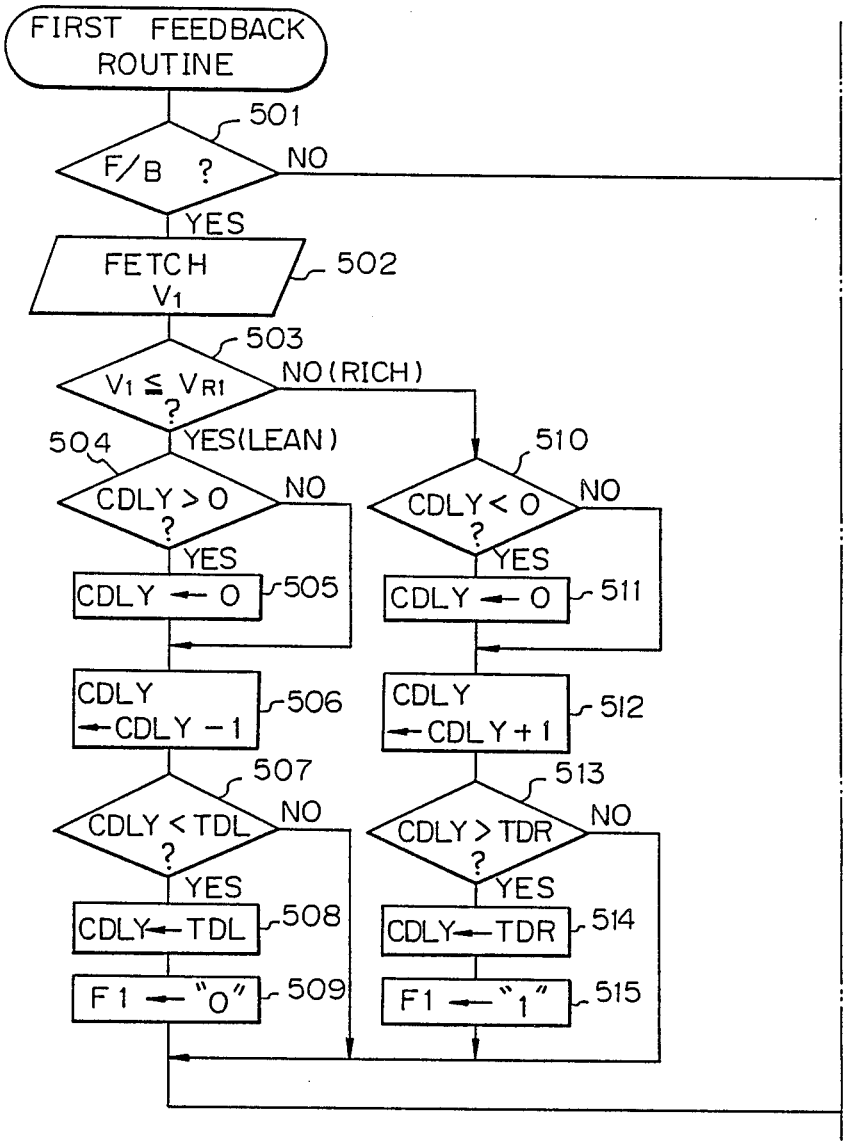
FIGS. 5, 5A–5C, 7, 7A–7C, 8, 10, 10A–10C, and 11 are flow charts showing the operation of the control circuit of FIG. 4.
Figure 5B:
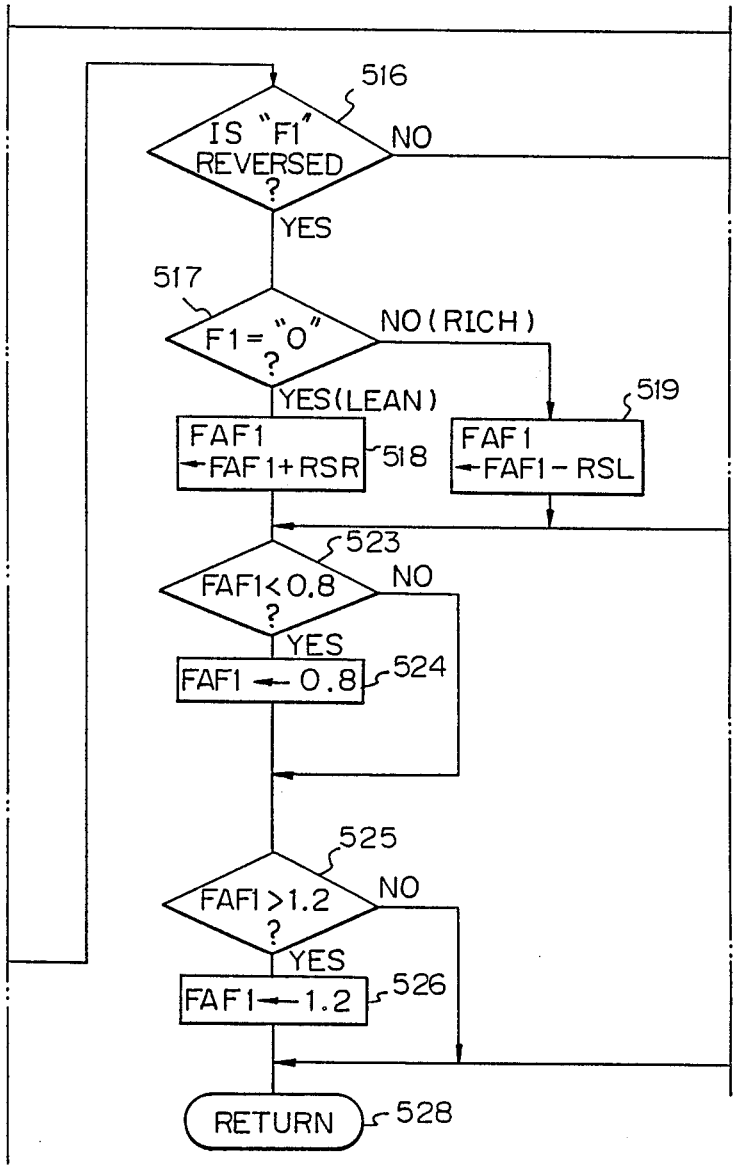
Figure 5C:
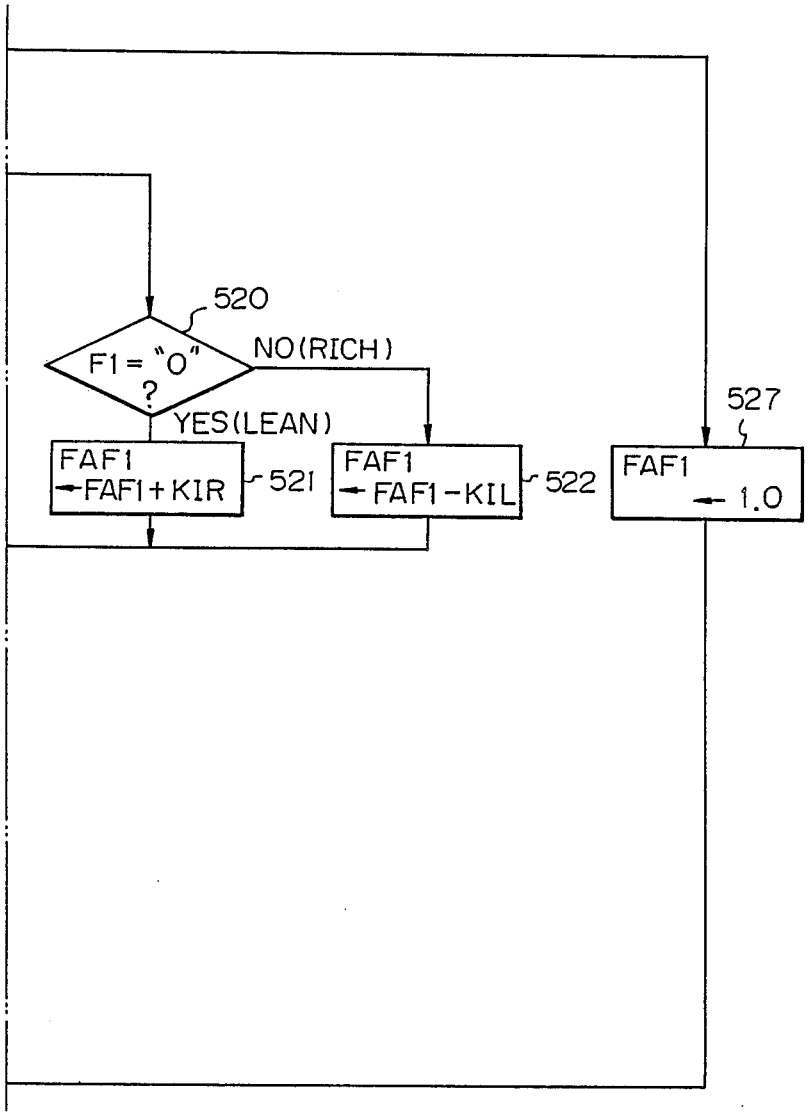

FIG. 5 is a routine for calculating a first air-fuel ratio feedback correction amount FAF1 in accordance with output of the upstream-side $O_2$ sensor 13 executed at every predetermined time period such as 4 ms. At step 501, it is determined whether or not all of the feedback control (closed-loop control) conditions by the upstream-side 02 sensor 13 are satisfied. The feedback control conditions are as follows:

(i) the engine is not in a starting state;
(ii) the coolant temperature THW is higher than 50° C.;
(iii) the power fuel incremental amount FPOWER is 0; and
(iv) the upstream-side $O_2$ sensor 13 is in an activated state.

Note that the determination of activation/nonactivation of the upstream-side $O_2$ sensor 13 is carried out by determining whether or not the coolant temperature THW≧70° C., or by whether or not the output of the upstream-side $O_2$ sensor 13 is once swung, i.e., once changed from the rich side to the lean side, or vice versa. Of course, other feedback control conditions are introduced as occasion demands. However, an explanation of such other feedback control conditions is omitted.

If one of more of the feedback control conditions is not satisfied, the control proceeds to step 527, in which the amount FAF1 is caused to be 1.0 (FAF1=1.0), thereby carrying out an open-loop control operation. Note that, in this case, the amount FAF1 can be a value or a mean value immediately before the open-loop control operation. That is, the amount FAF1 or a mean value $\overline{FAF1}$ thereof is stored in the backup RAM 106, and in an open-loop control operation, the value FAF1 or $\overline{FAF1}$ is read out of the backup RAM 106. Contrary to the above, at step 501, if all of the feedback control conditions are satisfied, the control proceeds the step 502.

At step 502, an A/D conversion is performed upon the output voltage $V_1$ of the upstream-side $O_2$ sensor 13, and the A/D converted value thereof is then fetched from the A/D converter 101. Then at step 503, the voltage $V_1$ is compared with a reference voltage $V_{R1}$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq V_{R1}$, which means that the current air-fuel ratio is lean, the control proceeds to step 504, which determines whether or not the value of a delay counter CDLY is positive. If CDLY>0, the control proceeds to step 505, which clears the delay counter CDLY, and then proceeds to step 506. If CDLY ≦0, the control proceeds directly to step 506. At step 506, the delay counter CDLY is counted down by 1, and at step 507, it is determined whether or not CDLY <TDL. Note that TDL is a lean delay time period for which a rich state is maintained even after the output of the upstream-side $O_2$ sensor 13 is changed from the rich side to the lean side, and is defined by a negative value. Therefore, at step 507, only when CDLY<TDL does the control proceed to step 508, which causes CDLY to be TDL, and then to step 509, which causes a first air-fuel ratio flag F1 to be "0" (lean state). On the other hand, if $V_1 > V_{R1}$, which means that the current air-fuel ratio is rich, the control proceeds to step 510, which determines whether or not the value of the delay counter CDLY is negative. If CDLY<0, the control proceeds to step 511, which clears the delay counter CDLY, and then proceeds to step 512. If CDLY≧0, the control directly proceeds to 512. At step 512, the delay counter CDLY is counted up by 1, and at step 513, it is determined whether or not CDLY>TDR. Note that TDR is a rich delay time period for which a lean state is maintained even after the output of the upstream-side $O_2$ sensor 13 is changed from the lean side to the rich side, and is defined by a positive value. Therefore, at step 513, only when CDLY>TDR does the control proceed to step 514, which causes CDLY to TDR, and then to step 515, which causes the first air-fuel ratio flag F1 to be "1" (rich state).

Next, at step 516, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed, the control proceeds to steps 517 to 519, which carry out a skip operation.

At step 517, if the flag F1 is "0" (lean) the control proceeds to step 518, which remarkably increases the correction amount FAF1 by a skip amount RSR. Also, if the flag F1 is "1" (rich) at step 517, the control proceeds to step 519, which remarkably decreases the correction amount FAF1 by a skip amount RSL.

On the other hand, if the first air-fuel ratio flag F1 is not reversed at step 516, the control proceeds to steps 520 to 522, which carries out an integration operation. That is, if the flag F1 is "0" (lean) at step 520, the control proceeds to step 521, which gradually increases the correction amount FAF1 by a rich integration amount KIR. Also, if the flag F1 is "1" (rich) at step 520, the control proceeds to step 522, which gradually decreases the correction amount FAF1 by a lean integration amount KIL.

The correction amount FAF1 is guarded by a minimum value 0.8 at steps 523 and 524. Also, the correction amount FAF1 is guarded by a maximum value 1.2 at steps 525 and 526. Thus, the controlled air-fuel ratio is prevented from becoming overlean or overrich.

The correction amount FAF1 is then stored in the RAM 105, thus completing this routine of FIG. 5 at steps 528.

Figures 6A, 6B, 6C, 6D:
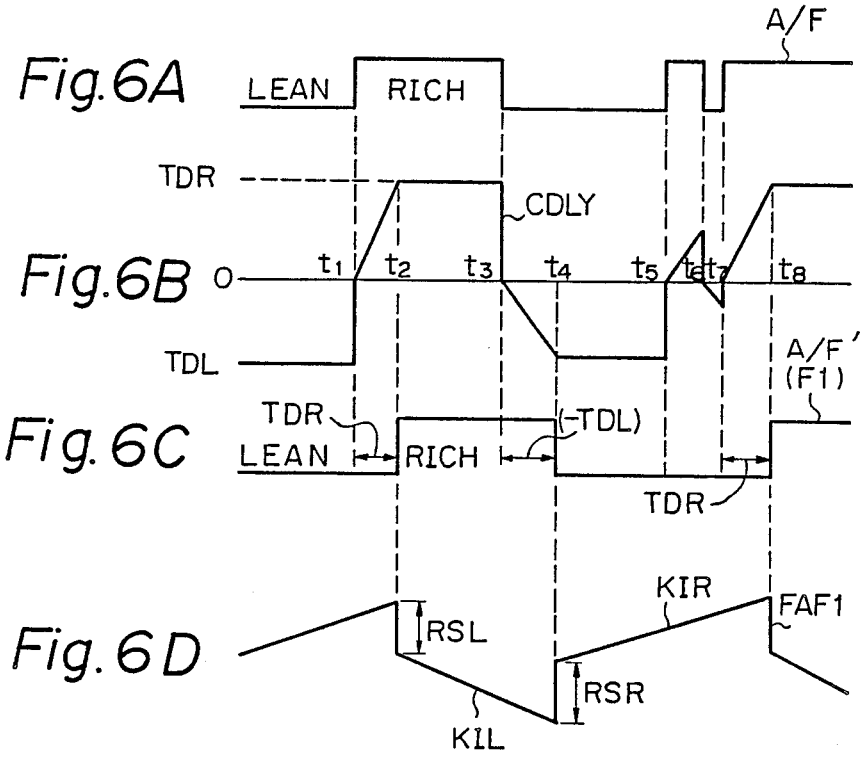
FIGS. 6A through 6D are timing diagrams explaining the flow chart of FIG. 5.

The operation by the flow chart of FIG. 5 will be further explained with reference to FIGS. 6A through 6D. As illustrated in FIG. 6A, when the air-fuel ratio A/F is obtained by the output of the upstream-side $O_2$ sensor 13, the delay counter CDLY is counted up during a rich state, and is counted down during a lean state, as illustrated in FIG. 6B. As a result, a delayed air-fuel ratio corresponding to the first air-fuel ratio flag F1 is obtained as illustrated in FIG. 6C. For example, at time $t_1$, even when the air-fuel ratio A/F is changed from the lean side to the rich side, the delayed air-fuel ratio A/F' (F1) is changed at time $t_2$ after the rich delay time period TDR. Similarly, at time $t_3$, even when the air-fuel ratio A/F is changed from the rich side to the lean side, the delayed air fuel ratio F1 is changed at time $t_4$ after the lean delay time period TDL. However, at time $t_5$, $t_6$, or $t_7$, when the air-fuel ratio A/F is reversed within a shorter time period than the rich delay time period TDR or the lean delay time period TDL, the delay air-fuel ratio A/F' is reversed at time $t_8$. That is, the delayed air-fuel ratio A/F' is stable when compared with the air-fuel ratio A/F. Further, as illustrated in FIG. 6D, at every change of the delayed air-fuel ratio A/F' from the rich side to the lean side, or vice versa, the correction amount FAF is skipped by the skip amount RSR or RSL, and in addition, the correction amount FAF1 is gradually increased or decreased in accordance with the delayed air-fuel ratio A/F'.

Air-fuel ratio feedback control operations by the downstream-side $O_2$ sensor 15 will be explained. There are two types of air-fuel ratio feedback control operations by the downstream-side $O_2$ sensor 15, i.e., the operation type in which a second air-fuel ratio correction amount FAF2 is introduced thereinto, and the operation type in which an air-fuel ratio feedback control parameter in the air-fuel ratio feedback control operation by the upstream-side $O_2$ sensor 13 is variable. Further, as the air fuel ratio feedback control parameter, there are nominated a delay time period TD (in more detail, the rich delay time period TDR and the lean delay time period TDL), a skip amount RS (in more detail, the rich skip amount RSR and the lean skip amount RSL), an integration amount KI (in more detail, the rich integration amount KIR and the lean integration amount KIL), and the reference volta $V_{R1}$.

For example, if the rich delay time period becomes longer than the lean delay time period (TDR>(−TDL)), the controlled air-fuel becomes richer, and if the lean delay time period becomes longer than the rich delay time period ((−TDL) >TDR), the controlled air-fuel ratio becomes leaner. Thus, the air-fuel ratio can be controlled by changing the rich delay time period TDR1 and the lean delay time period (−TDL) in accordance with the output of the downstream-side $O_2$ sensor 15. Also, if the rich skip amount RSR is increased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing he rich skip amount RSR and the lean skip amount RSL in accordance with the output downstream-side $O_2$ sensor. Further, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIL in accordance with the output of the downstream-side $O_2$ sensor 15. Still further, if the reference voltage $V_{R1}$ is increased, the controlled air-fuel ratio becomes richer, and if the reference voltage $V_{R1}$ is decreased, the controlled air-fuel ratio becomes leaner. Thus, the air-fuel ratio can be controlled by changing the reference voltage $V_{R1}$ in accordance with the output of the downstream-side $O_2$ sensor 15.

There are various merits in the control of the air-fuel ratio feedback control parameters by the output $V_2$ of the downstream-side $O_2$ sensor 15. For example, when the delay time periods TDR and TDL are controlled by the output $V_2$ of the downstream-side $O_2$ sensor 15, it is possible to precisely control the air-fuel ratio. Also, when the skip amounts RSR and RSL are controlled by the output $V_2$ of the downstream-side $O_2$ sensor 15, it is possible to improve the response speed of the air-fuel ratio feedback control by the output $V_2$ of the downstream-side $O_2$ sensor 15. Of course, it is possible to simultaneously control two or more kinds of the air-fuel ratio feedback control parameters by the output $V_2$ of the downstream-side $O_2$ sensor 15.

A double $O_2$ sensor system into which a second air-fuel ratio correction amount FAF2 is introduced will be explained with reference to FIGS. 7 and 8.

Figures 7, 7A:
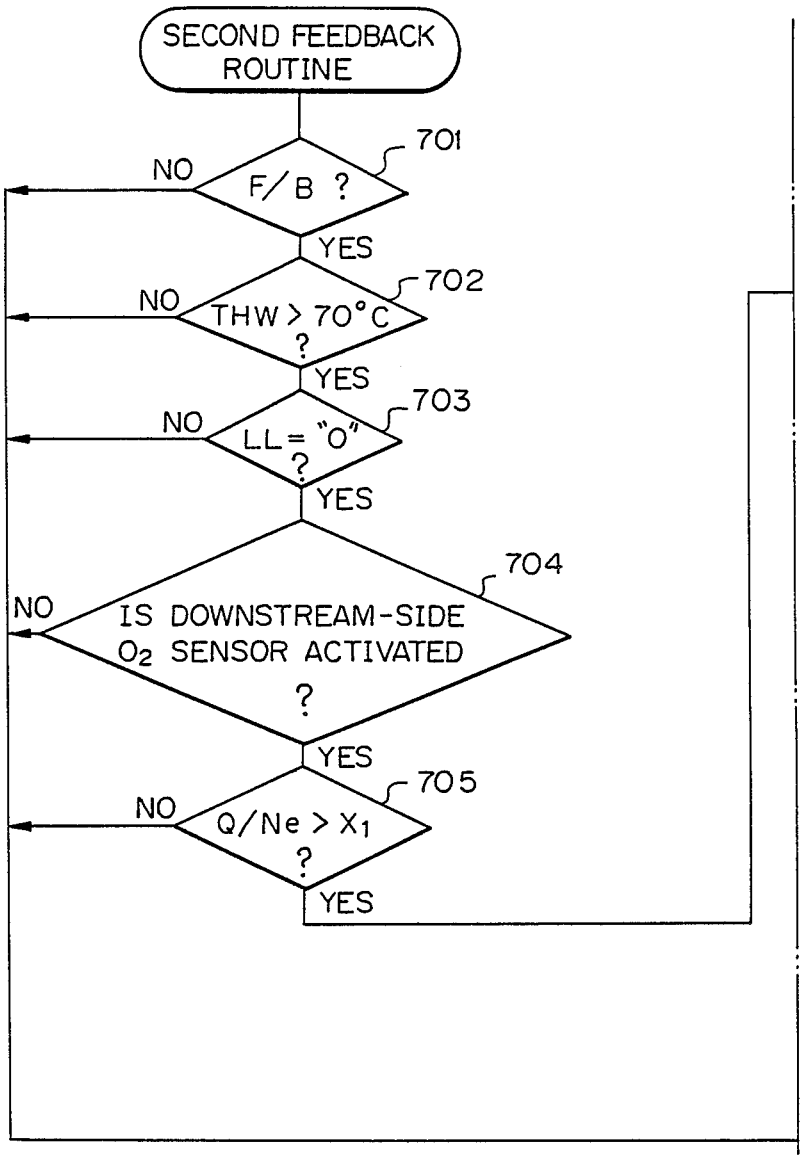
Figure 7B:
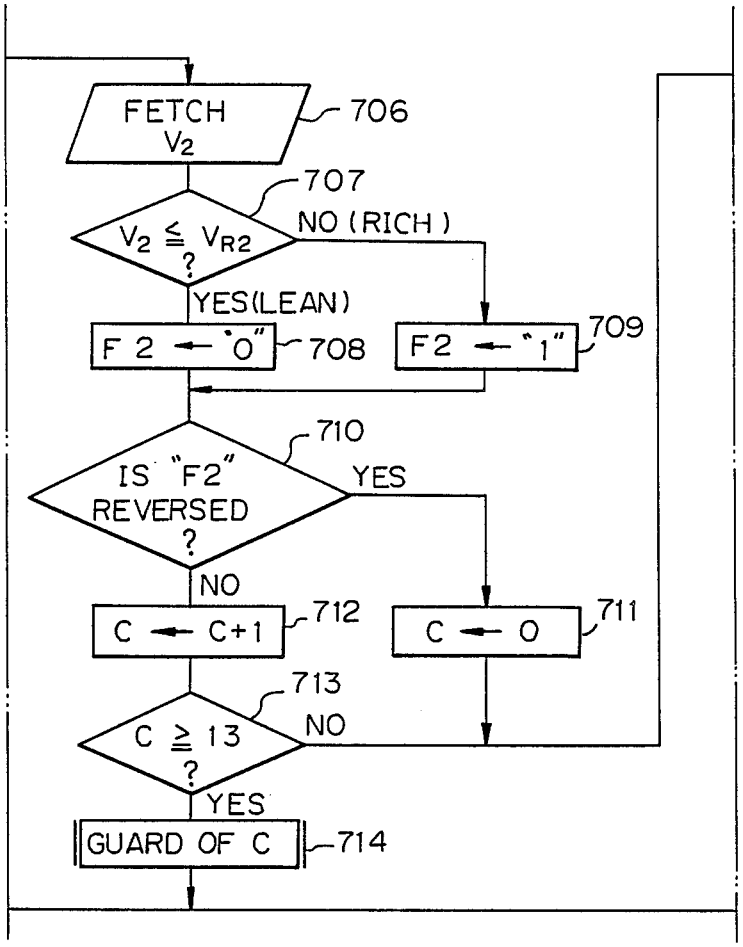
Figure 7C:
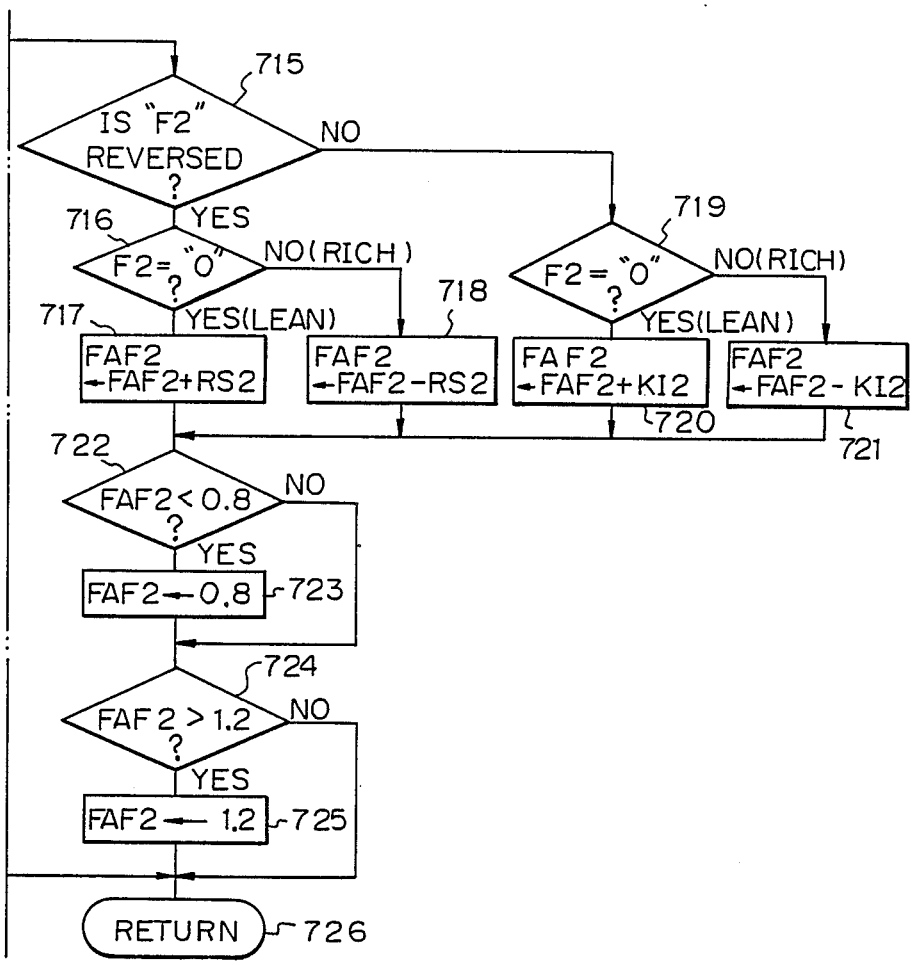

FIG. 7 is a routine for calculating a second air-fuel ratio feedback correction amount FAF2 in accordance with the output of the downstream-side $O_2$ sensor 15 executed at every predetermined time period such as 1 s.

At steps 701 through 705, it is determined whether or not all of the feedback control (closed-loop control) conditions by the downstream-side $O_2$ sensor 15 are satisfied. For example, at step 701, it is determined whether or not the feedback control conditions by the upstream-side $O_2$ sensor 13 are satisfied. At step 702, it is determined whether or not the coolant temperature THW is higher than 70° C. At step 703, it is determined whether or not the throttle valve 16 is open (LL="0"). At step 704, it is determined whether or not the output of the downstream-side 02 sensor 15 has been once changed from the lean side to the rich side or vice versa. At step 705, it is determined whether or not a load parameter such as Q/Ne is larger than a predetermined value $X_1$. Of course, other feedback control conditions are introduced as occasion demands. However, an explanation of such other feedback control conditions is omitted.

If one or more of the feedback control conditions is not satisfied, the control proceeds directly to step 726, thereby carrying out an open-loop control operation. Note that, in this case, the amount FAF2 or a mean value $\overline{FAF2}$ thereof is stored in the backup RAM 106, and in an open-loop control operation, the value FAF2 or $\overline{FAF2}$ is read out of the backup RAM 106.

Contrary to the above, if all of the feedback control conditions are satisfied, the control proceeds to step 706.

At step 706, an A/D conversion is performed upon the output voltage $V_2$ of the downstream-side $O_2$ sensor 15, and the A/D converted value thereof is then fetched from the A/D converter 101. Then, at step 707, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference volta $V_{R2}$ (=0.55 V) is preferably higher than the reference voltage $V_{R1}$ (=0.45 V), in consideration of the difference in output characteristics and deterioration speed between the $O_2$ sensor 13 upstream of the catalyst converter 12 and the $O_2$ sensor 15 downstream of the catalyst converter 12. However, the voltage $V_{R2}$ can be voluntarily determined.

At step 707, if the air-fuel ratio upstream of the catalyst converter 12 is lean, the control proceeds to step 708 which resets a second air-fuel ratio flag F2. Alternatively, the control proceeds to the step 709, which sets the second air-fuel ratio flag F2.

Next, at step 710, it is determined whether or not the second air-fuel ratio flag F2 is reversed, i.e., whether or not the air-fuel ratio detected by the downstream-side $O_2$ sensor 15 is reversed. If the second air-fuel ratio flag F2 is reversed, the control proceeds to step 711 which resets a timer counter C for measuring a time period of reversions of the output $V_2$ of the downstream-side air-fuel ratio sensor 15. Then, the control proceeds to step 715. On the other hand, if the second air-fuel ratio flag F2 is not reversed, the control proceeds to step 712 which counts up the timer counter C by +1. Then, at step 713, it is determined whether or not the value of the timer counter C is larger than a predetermined value such as 13 which corresponds to about 7 s. As a result if $C \leqq 13$, the control proceeds to step 715. Otherwise ($C > 13$), the control proceeds to step 714 which guards the value of the time counter C by a maximum value such as 14, and further proceeds to step 726. That is, when the time period of reversions of the output $V_2$ is remarkably increased, the air-fuel ratio feedback control by the downstream-side $O_2$ sensor 15 is substantially stopped.

Again, at step 715, it is determined whether or not the second air-fuel ratio flag F2 is reversed. If the second air-fuel ratio flag F2 is reversed, the control proceeds to steps 716 to 718 which carry out a skip operation. That is, if the flag F2 is "0" (lean) at step 716, the control proceeds to step 717, which remarkably increases the second correction amount FAF2 by a skip amount RS2. Also, if the flag F2 is "1" (rich) at step 716, the control proceeds to step 717, which remarkably decreases the second correction amount FAF2 by the skip amount RS2. On the other hand, if the second air-fuel ratio flag F2 is not reversed at step 715, the control proceeds to steps 719 to 721, which carry out an integration operation. That is, if the flag F2 is "0" (lean) at step 719, the control proceeds to step 720, which gradually increases the second correction amount FAF2 by an integration amount KI2. Also, if the flag F2 is "1" (rich) at step 720, the control proceeds to step 721, which gradually decreases the second correction amount FAF2 by the integration amount KI2.

Note that the skip amount RS2 is larger than the integration amount KI2.

The second correction amount FAF2 is guarded by a minimum value 0.8 at steps 722 and 723, and by a maximum value 1.2 at steps 724 and 725, thereby also preventing the controlled air-fuel ratio from becoming overrich or overlean.

The correction amount FAF2 is then stored in the backup RAM 106, thus completing this routine of FIG. 7 at step 726.

Figure 8:
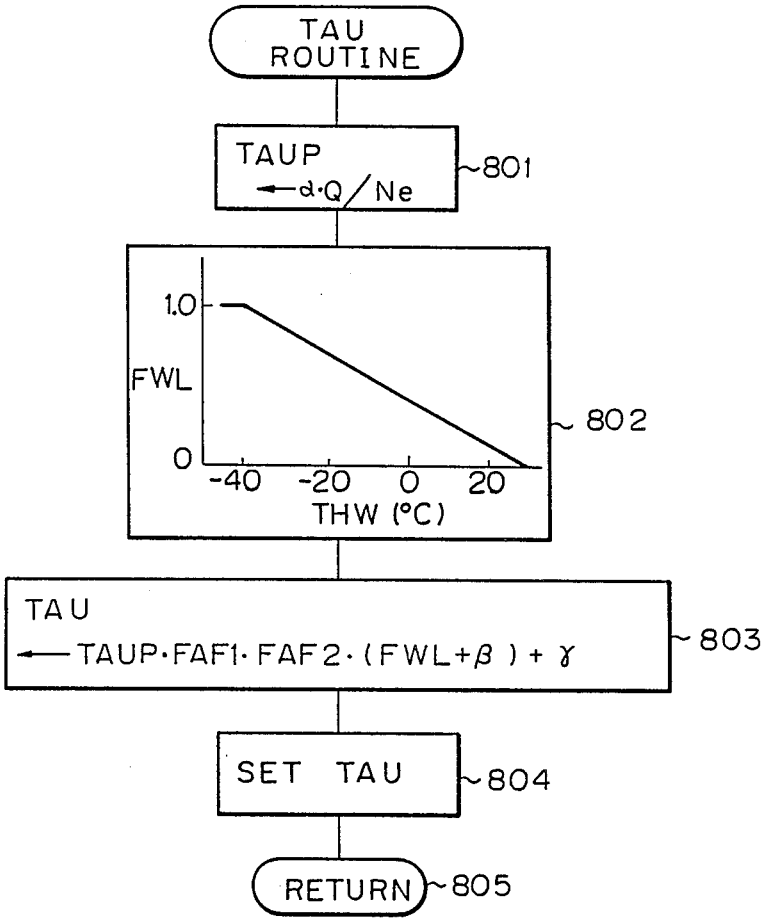

FIG. 8 is a routine for calculating a fuel injection amount TAU executed at every predetermined crank angle such as 360° CA. At step 801, a base fuel injection amount TAUP is calculated by using the intake air amount data Q and the engine speed data Ne stored in the RAM 105. That is, $$TAUP \leftarrow \alpha \cdot Q/Ne$$

where $\alpha$ is a constant. Then at step 802, a warming-up incremental amount FWL is calculated from a one-dimensional map stored in the ROM 104 by using the coolant temperature data THW stored in the RAM 105. Note that the warming-up incremental amount FWL decreases when the coolant temperature THW increases. At step 803, a final fuel injection amount TAU is calculated by $$TAU \leftarrow TAUP \cdot FAF1 \cdot FAF2 \cdot (FWL + \beta) + \gamma$$

where $\beta$ and $\gamma$ are correction factors determined by other parameters such as the voltage of the battery and the temperature of the intake air. At step 804, the final fuel injection amount TAU is set in the down counter 107, and in addition, the flip-flop 108 is set to initiate the activation of the fuel injection valve 7. Then, this routine is completed by step 805. Note that, as explained above, when a time period corresponding to the amount TAU has passed, the flip-flop 109 is reset by the carry-out signal of the down counter 108 to stop the activation of the fuel injection valve 7.

Figures 9A, 9B, 9C, 9D, 9E, 9F, 9G, 9H:
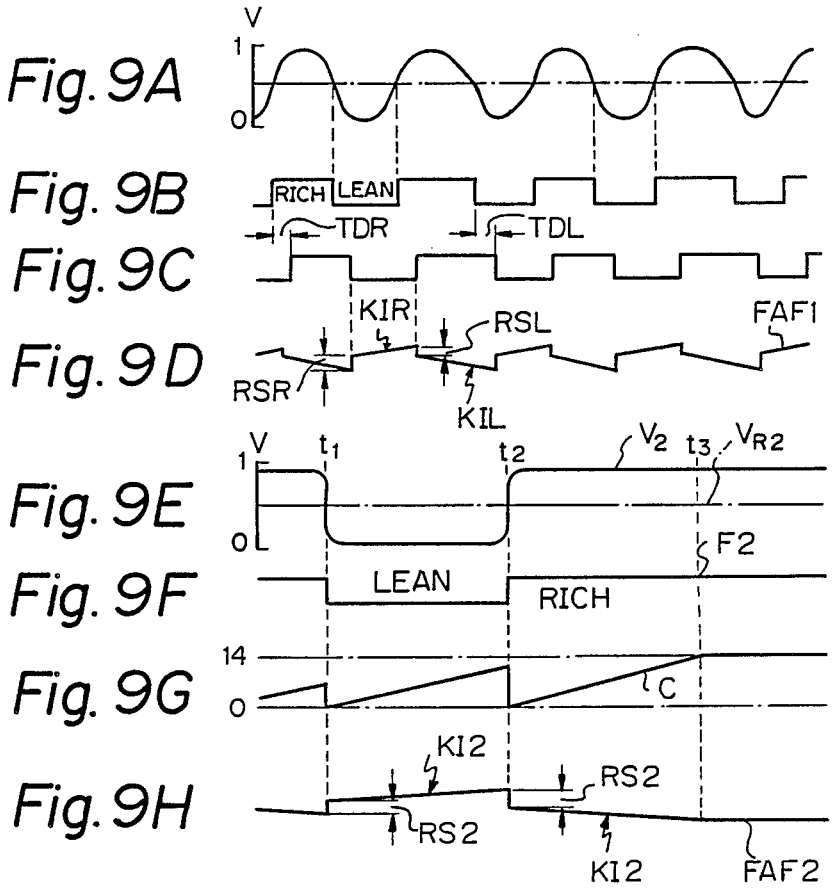
FIGS. 9A through 9H are timing diagrams explaining the flow charts of FIGS. 5, 7, and 10.

FIGS. 9A through 9H are timing diagrams for explaining the two air-fuel ratio correction amounts FAF1 and FAF2 obtained by the flow charts of FIGS. 5, 7, and 8. In this case, the engine is in a closed-loop control state for the two $O_2$ sensors 13 and 15. When the output of the upstream-side $O_2$ sensor 13 is changed as illustrated in FIG. 9A, the determination at step 503 of FIG. 5 is shown in FIG. 9B, and a delayed determination thereof corresponding to the first air-fuel ratio flag F1 is shown in FIG. 9C. As a result, as shown in FIG. 9D, every time the delayed determination is changed from the rich side to the lean side, or vice versa, the first air-fuel ratio correction amount FAF1 is skipped by the amount RSR or RSL. Otherwise, the first air-fuel ratio correction amount FAF1 is gradually changed by the amount KIR or KIL.

On the other hand, when the output of the downstream-side $O_2$ sensor 15 is changed as illustrated in FIG. 9E, the determination at 707 of FIG. 7 corresponding to the second air-fuel ratio flag F2 is shown in FIG. 9F. As a result, the timer counter C measures a time period of a lean state (F2="0") or a time period of a rich state (F2="1"). For example, as illustrated in FIG. 9G, a time period of a lean state defined by the period $t_1$ to $t_2$ is smaller than a definite value ($C \leqq 13$), while a time period of a rich state defined by the period $t_2$ to $t_3$ is larger than the definite value ($C > 13$). Therefore, as shown in FIG. 9H, every time the determination is changed from the rich side to the lean side, or vice versa, the second air-fuel ratio correction amount FAF2 is skipped by the skip amount RS2. Alternatively, the second air-fuel ratio correction amount FAF2 is gradually changed by the integration amount KI2. In this case, as illustrated in FIG. 7G, the calculation of the second air-fuel ratio correction amount FAF2 is stopped after time $t_2$.

A double $O_2$ sensor system, in which an air-fuel ratio feedback control parameter of the first air-fuel ratio feedback control by the upstream-side $O_2$ sensor is variable, will be explained with reference to FIGS. 10 and 11. In this case, the skip amounts RSR and RSL as the air-fuel ratio feedback control parameters are variable.

Figures 10, 10A:
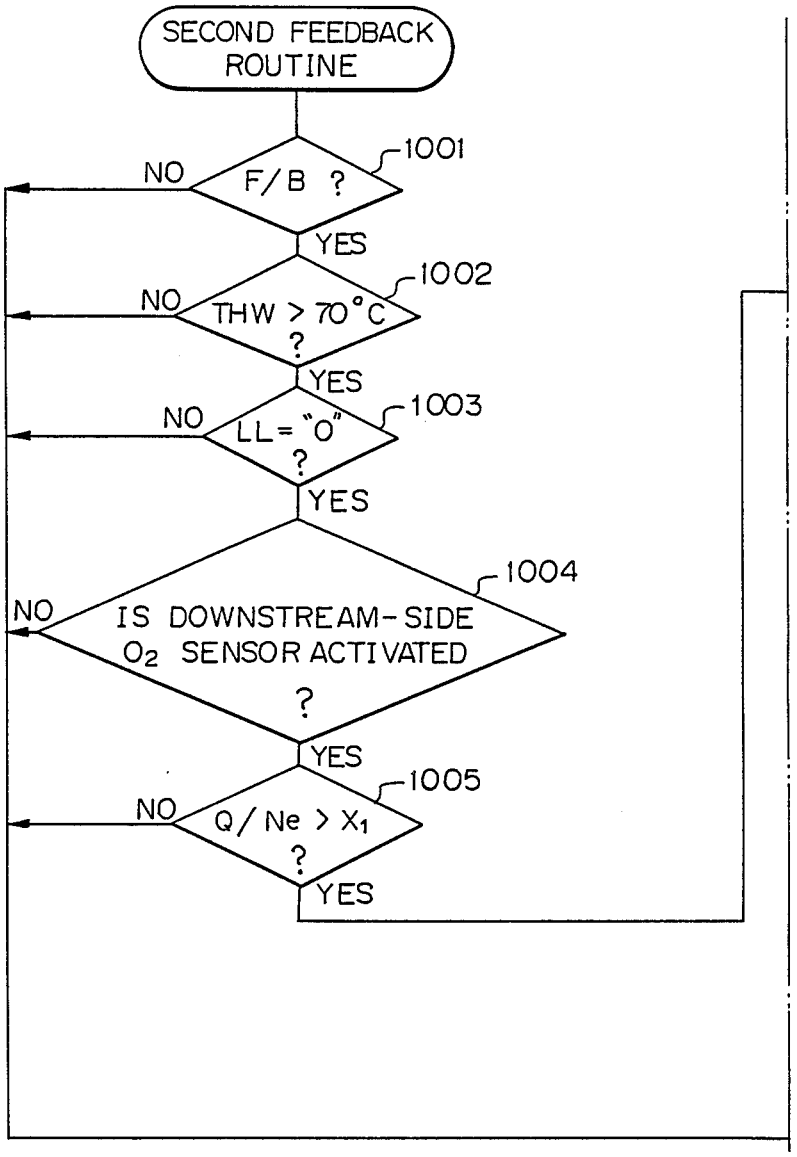
Figure 10B:
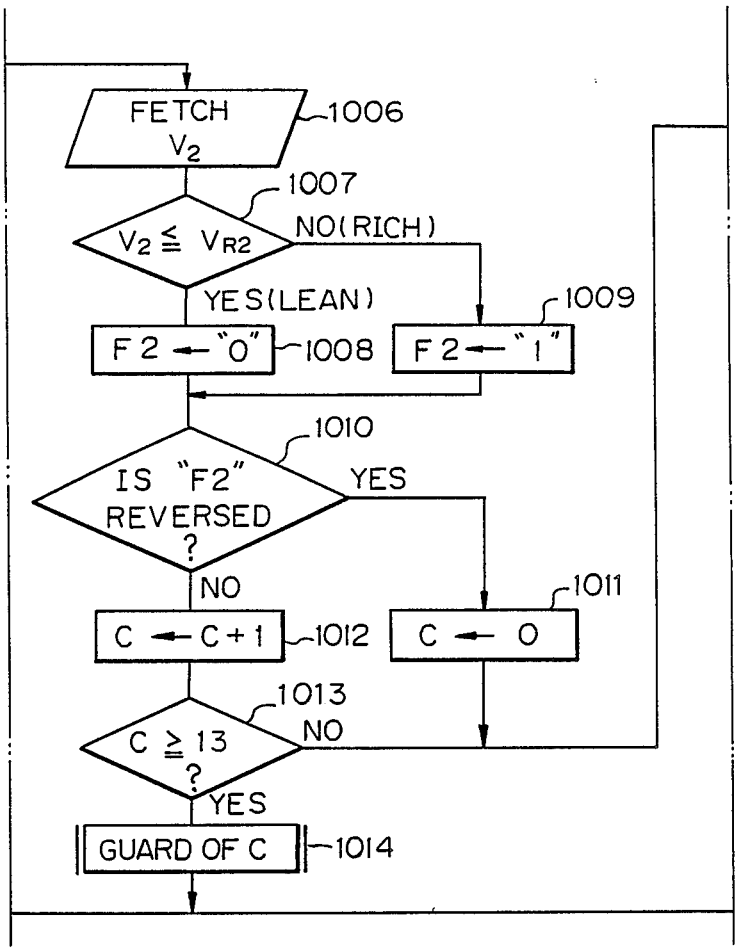
Figure 10C:
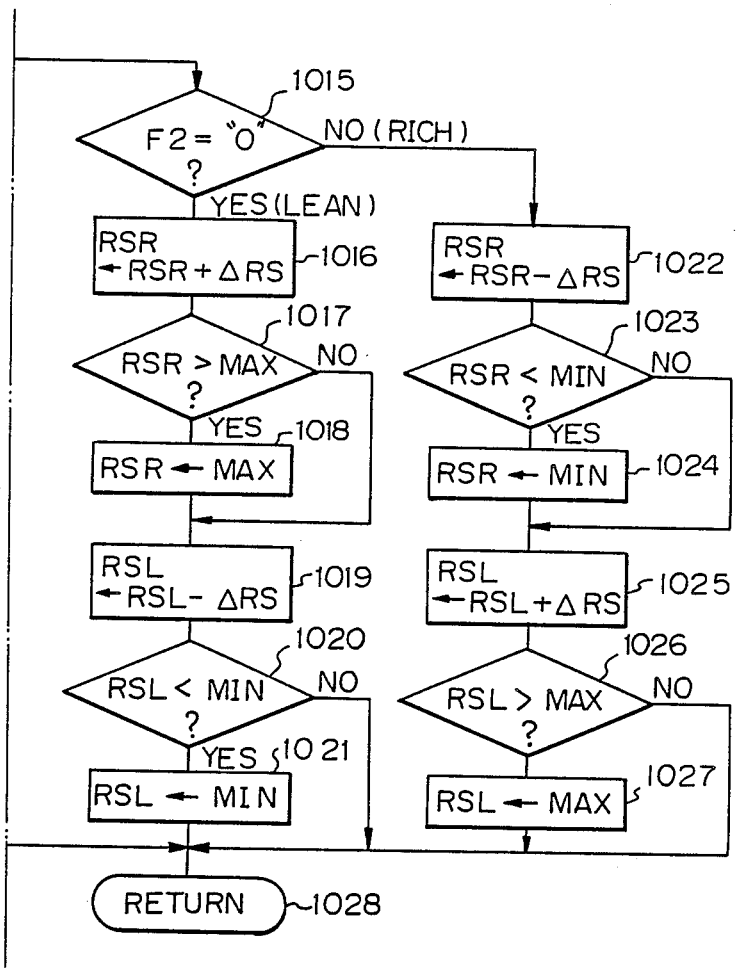

FIG. 10 is a routine for calculating the skip amounts RSR and RSL in accordance with the output of the downstream-side $O_2$ sensor 15 executed at every predetermined time period such as 1 s.

Steps 1001 through 1014 are the same as steps 701 through 714 of FIG. 7. That is, if one or more of the feedback control conditions is not satisfied, the control proceeds directly to step 1028, thereby carrying out an open-loop control operation. Also, even when all of the feedback conditions are satisfied, if a time period of a lean state (F2="0") or a time period of a rich state (F2="1") is larger than the definite value ($C > 13$), the control proceeds to step 1027 which carries out an open-loop control operation. Note that, in this case, the amounts RSR and RSL or the mean values $\overline{RSR}$ and $\overline{RSL}$ thereof are stored in the backup RAM 106, and in an open-loop control operation, the values RSR and RSL or $\overline{RSR}$ and $\overline{RSL}$ are read out of the backup RAM 106.

At step 1015, it is determined whether or not the second air-fuel ratio F2 is "0". If F2="0", which means that the air-fuel ratio downstream of the catalyst converter 12 is lean, the control proceeds to steps 1016 through 1021, and if F2 ="1", which means that the air-fuel ratio is rich, the control proceeds to steps 1022 through 1027.

At step 1016, the rich skip amount RSR is increased by a definite value ΔRS which is, for example, 0.08%, to move the air-fuel ratio to the rich side. At steps 1017 and 1018, the rich skip amount RSR is guarded by a maximum value MAX which is, for example, 7.5%.

At step 1019, the lean skip amount RSL is decreased by the definite value ΔRS to move the air-fuel ratio to the rich side. At steps 1020 and 1021, the lean skip amount RSL is guarded by a minimum value MIN which is, for example, 2.5%.

On the other hand, if F2="1" (rich), at step 1022, the rich skip amount RSR is decreased by the definite value ΔRS to move the air-fuel ratio to the lean side. At steps 1023 and 1024, the rich skip amount RSR is guarded by the minimum value MIN. Further, at step 1025, the lean skip amount RSL is decreased by the definite value ΔRS to move the air-fuel ratio to the rich side. At steps 1026 and 1027, the lean skip amount RSL is guarded by the maximum value MAX.

The skip amounts RSR and RSL are then stored in the backup RAM 106, thereby completing this routine of FIG. 10 at step 1028.

Thus, according to the routine of FIG. 10, when the output of the second $O_2$ sensor 15 is lean, the rich skip amount RSR is gradually increased, and the lean skip amount RSL is gradually decreased, thereby moving the air-fuel ratio to the rich side. Conversely, when the output of the second $O_2$ sensor 15 is rich, the rich skip amount RSR is gradually decreased, and the lean skip amount RSL is gradually increased, thereby moving the air-fuel ratio to the lean side. In this case, when the timer counter C reaches 14, the calculation of the skip amounts RSR and RSL is prohibited.

Figure 11:
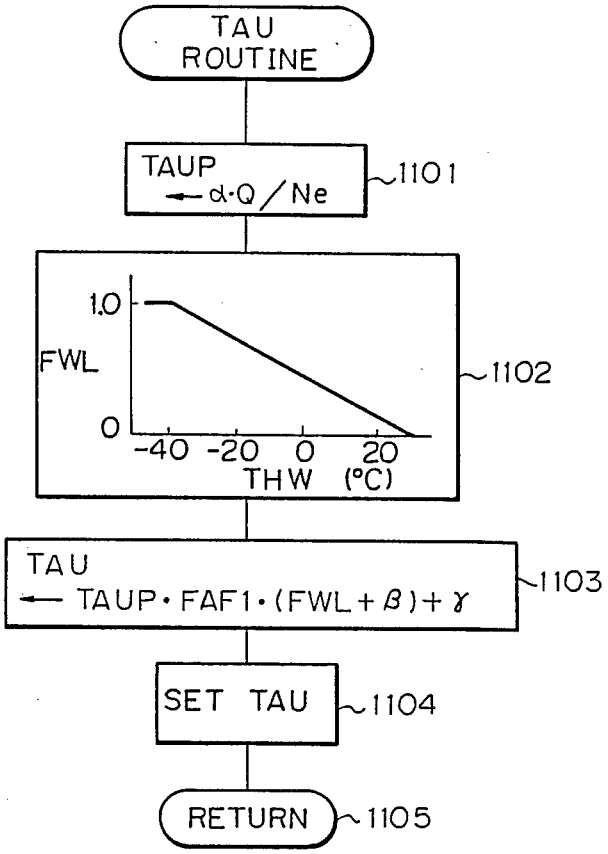

FIG. 11 is a routine for calculating a fuel injection amount TAU executed at every predetermined crank angle such as 360° CA. At step 1101, a base fuel injection amount TAUP is calculated by using the intake air amount data Q and the engine speed data Ne stored in the RAM 105. That is, $$TAUP \leftarrow \alpha \cdot Q/Ne$$

where $\alpha$ is a constant. Then at step 1102, a warming-up incremental amount FWL is calculated from a one-dimensional map by using the coolant temperature data THW stored in the RAM 105. Note that the warming-up incremental amount FWL decreased when the coolant temperature THW increases. At step 1103, a final fuel injectional amount TAU is calculated by $$TAU \leftarrow TAUP \cdot FAF1 \cdot (FWL + \beta) + \gamma$$

where $\beta$ and $\gamma$ are correction factors determined by other parameters such as the voltage of the battery and the temperature of the intake air. At step 1104, the final fuel injection amount TAU is set in the down counter 108, and in addition, the flip-flop 109 is set to initiate the activation of the fuel injection valve 7. This routine is then completed by step 1105. Note that, as explained above, when a time period corresponding to the amount TAU has passed, the flip-flop 109 is reset by the carry-out signal of the down counter 108 to stop the activation of the fuel injection valve 7.

Figures 12A, 12B, 12C, 12D, 12E, 12F, 12G, 12H, 12I:
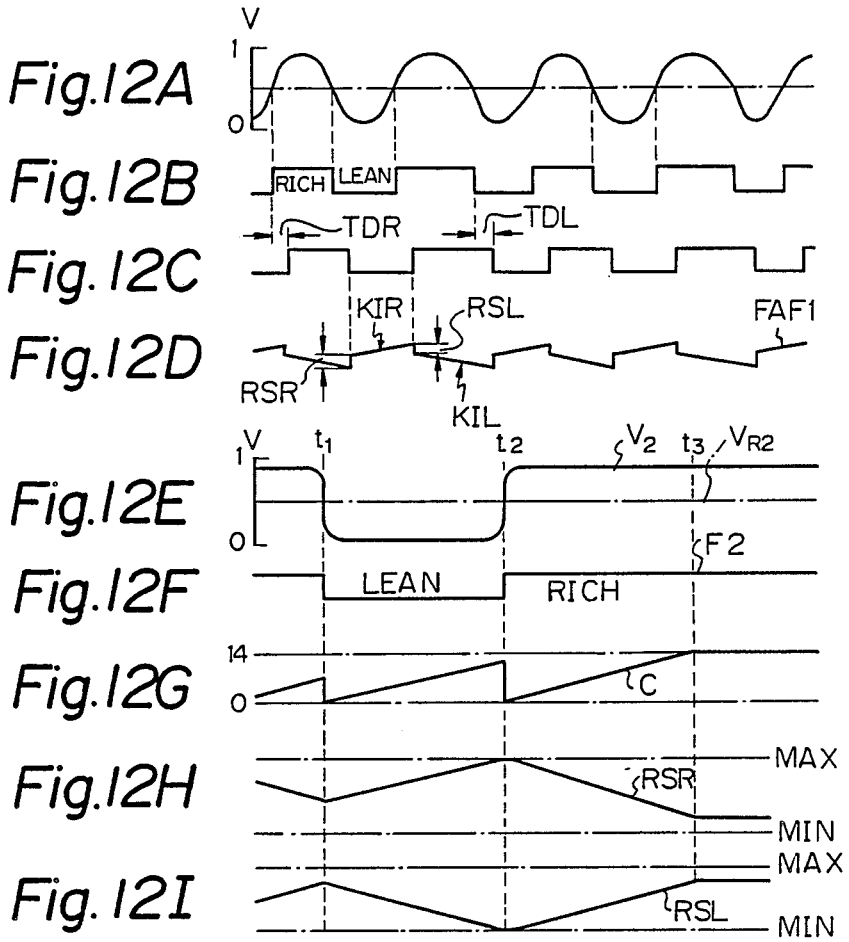
FIGS. 12A through 12I are timing diagrams explaining the flow charts of FIGS. 5, 10, and 11.

FIGS. 12A through 12I are timing diagrams for explaining the air-fuel ratio correction amount FAF1 and the skip amounts RSR and RSL obtained by the flow charts of FIGS. 5, 10 and 11. FIGS. 12A through 12G are the same as FIGS. 7A through 7G, respectively. As shown in FIGS. 12H and 12G, when the determination at step 1007 is lean, the rich skip amount RSR is increased and the lean skip amount RSL is decreased, and when the determination at step 1008 is rich, the rich skip amount RSR is decreased and the lean skip amount RSL is increased. In this case, the skip amounts RSR and RSL are changed within a range of from MAX to MIN. Also in this case, as illustrated in FIGS. 12H and 12I, the calculation of the skip amounts RSR and RSL is stopped after time $t_2$:

Also, the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. That is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the integration amounts KIR and KIL, the delay time periods TDR and TDL, or the reference voltage $V_{R1}$, are variable.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 601 of FIG. 8 or at step 1101 or FIG. 11 is determined by the carburetor itself, i.e., the intake air negative pressure and the engine speed, and the air amount corresponding to TAU at step 803 of FIG. 8 or at step 1103 of FIG. 11.

Further, a CO sensor, a lean-mixture sensor or the like can be also used instead of the $O_2$ sensor.

As explained above, according to the present invention, when a time period of reversions of the output of the downstream side air-fuel ratio sensor is remarkably increased, the air-fuel ratio feedback control by the downstream-side air-fuel ratio sensor is stopped, thereby avoiding overcorrection of the air-fuel ratio correction amount, and thus improving the transient characteristics, the drivability characteristics, and the emission characteristics.

What is claimed:

1. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

calculating an air-fuel ratio correction amount in accordance with the outputs of said upstream-side and downstream-side air-fuel ratio sensors;

determining whether said downstream-side air-fuel ratio sensor is activated;

measuring a time period of reversions of the output of said downstream-side air-fuel ratio sensor;

determining whether said time period is larger than a predetermined value;

prohibiting a calculation of said air-fuel ratio correction amount by the output of said downstream-side air-fuel ratio sensor when said time period is larger than said predetermined value and said downstream-side air-fuel ratio sensor is activated; and adjusting an actual air-fuel ratio of said engine in accordance with said air-fuel ratio correction.

2. A method as set forth in claim 1, wherein said air-fuel ratio correction amount calculating step comprises the steps of:

calculating a first air-fuel ratio correction amount in accordance with the output of said upstream-side air-fuel ratio sensor; and calculating a second air-fuel ratio correction amount in accordance with the output of said downstream-side air-fuel ratio sensor, thereby calculating said air-fuel ratio correction amount in accordance with said first and second air-fuel ratio correction amounts, said prohibiting step prohibiting a calculation of said second air-fuel ratio correction amount.

3. A method as set forth in claim 1, wherein said air-fuel ratio correction amount calculating step comprises a step of calculating an air-fuel ratio feedback control parameter in accordance with the output of said downstream-side air-fuel ratio sensor, thereby calculating said air-fuel ratio correction amount in accordance with the output of said upstream-side air-fuel ratio sensor and said air-fuel ratio feedback control parameter, said prohibiting step prohibiting a calculation of said air-fuel ratio feedback control parameter.

4. A method as set forth in claim 3, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

5. A method as set forth in claim 3, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

6. A method as set forth in claim 3, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

7. A method as set forth in claim 3, wherein said air-fuel ratio feedback control parameter is determined by a reference voltage with which the output of said upstream-side air-fuel ratio sensor is compared, thereby determining whether the air-fuel ratio is on the rich side or on the lean side.

8. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for calculating an air-fuel ratio correction amount in accordance with the outputs of said upstream-side and downstream-side air-fuel ratio sensors;

means for determining whether said downstream-side air-fuel ratio sensor is activated;

means for measuring a time period of reversions of the output of said downstream-side air-fuel ratio sensor;

means for determining whether said time period is larger than a predetermined value;

means for prohibiting a calculation of said air-fuel ratio correction amount by the output of said downstream-side air-fuel ratio sensor when said time period is larger than said predetermined value and said downstream-side air-fuel ratio sensor is activated; and means for adjusting an actual air-fuel ratio of said engine in accordance with said air-fuel ratio correction.

9. An apparatus as set forth in claim 8, wherein said air-fuel ratio correction amount calculating means comprises:

means for calculating a first air-fuel ratio correction amount in accordance with the output of said upstream-side air-fuel ratio sensor; and means for calculating a second air-fuel ratio correction amount in accordance with the output of said downstream-side air-fuel ratio sensor, thereby calculating said air-fuel ratio correction amount in accordance with said first and second air-fuel ratio correction amounts, said prohibiting means prohibiting a calculation of said second air-fuel ratio correction amount.

10. An apparatus as set forth in claim 8, wherein said air-fuel ratio correction amount calculating means comprises means for calculating an air-fuel ratio feedback control parameter in accordance with the output of said downstream-side air-fuel ratio sensor, thereby calculating said air-fuel ratio correction amount in accordance with the output of said upstream-side air-fuel ratio sensor and said air-fuel ratio feedback control parameter, said prohibiting means prohibiting a calculation of said air-fuel ratio feedback control parameter.

11. A method as set forth in claim 10, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

12. A method as set forth in claim 10, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

13. A method as set forth in claim 10, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

14. A method as set forth in claim 10, wherein said air-fuel ratio feedback control parameter is determined by a reference voltage with which the output of said upstream-side air-fuel ratio sensor is compared, thereby determining whether the air-fuel ratio is on the rich side or on the lean side.

* * * * *